US008863471B2

(12) United States Patent
Pfluger

(10) Patent No.: US 8,863,471 B2
(45) Date of Patent: Oct. 21, 2014

(54) FALSE FLOOR AND METHOD AND DEVICE FOR THE INSTALLATION THEREOF

(75) Inventor: Gerd Pfluger, Oberbuchsiten (CH)

(73) Assignee: Zurecon AG, Zurich (CH)

( * ) Notice: Subject to any disclaimer, the term of this patent is extended or adjusted under 35 U.S.C. 154(b) by 0 days.

(21) Appl. No.: 14/123,265

(22) PCT Filed: May 31, 2012

(86) PCT No.: PCT/EP2012/060240

§ 371 (c)(1),
(2), (4) Date: Dec. 2, 2013

(87) PCT Pub. No.: WO2012/168134

PCT Pub. Date: Dec. 13, 2012

(65) Prior Publication Data

US 2014/0102012 A1 Apr. 17, 2014

(30) Foreign Application Priority Data

Jun. 10, 2011 (EP) ..... 11169610
Jun. 27, 2011 (EP) ..... 11171483
Mar. 10, 2012 (EP) ..... 12158963

(51) Int. Cl.
*E04B 9/00* (2006.01)
*E04F 15/024* (2006.01)
*E04F 15/02* (2006.01)

(52) U.S. Cl.
CPC ..... *E04F 15/02452* (2013.01); *E04F 15/02464* (2013.01); *E04F 15/02* (2013.01)
USPC ..... 52/745.13; 52/1; 52/126.6

(58) Field of Classification Search
CPC .... E04F 15/024; E04F 15/02476; E04F 21/20
USPC ..... 52/1, 126.6, 745.13
See application file for complete search history.

(56) References Cited

U.S. PATENT DOCUMENTS 4,570,397 A 2/1986 Creske
5,265,386 A * 11/1993 Muhlethaler ..... 52/126.6
2003/0051420 A1 3/2003 Leon

FOREIGN PATENT DOCUMENTS

EP 0309399 A1 3/1989
EP 0479720 A1 4/1992
JP 2002089022 A 3/2002

* cited by examiner

*Primary Examiner* — Mark Wendell
(74) *Attorney, Agent, or Firm* — Fraser Clemens Martin & Miller LLC; William J. Clemens

(57) ABSTRACT

A method and a device serve for the installation of a false floor above a bare floor include false-floor supports that are placed in a regular grid pattern on the bare floor, on which floor panels are arranged alongside one another in rows. Mounting positions are determined for the false-floor supports and the false-floor supports to be installed are correspondingly positioned. Furthermore, a mounting plane lying at a mounting height is at least partially determined preferably by using laser devices. The false-floor supports to be installed are then positioned relative to the mounting plane. Pedestals, which are composed of solidifying pedestal material that is binding to the bare floor and which project beyond the mounting plane, are provided at the mounting positions before, during or after the positioning of the false-floor supports. The false-floor supports are then held each in the respective pedestal until the latter has solidified.

18 Claims, 12 Drawing Sheets

1
2
21
22
23
10
211
212
213
2A
2B
2C
3
230
$h_{DB}$
$h_Z$
$h_M$
$h_P$

FALSE FLOOR AND METHOD AND DEVICE FOR THE INSTALLATION THEREOF

FIELD OF THE INVENTION

The invention relates to a false floor as well as to a method and a device for the installation of this false floor.

BACKGROUND OF THE INVENTION

False floors are often installed in large modern buildings. As described in EP0309399A1, a false floor consists of floor panels, which are mounted on false-floor supports, that are adjustable in height and that are placed on the building floor, i.e. on the bare floor of the building. Hence, a small space results between the bare floor and the false floor, in which media lines of all kinds, such as water lines, gas lines and electrical cable, can be installed in the shortest distances, wherefore a detailed planning of the installation is not required.

EP0309399A1 further discloses a false-floor support with a foot member and a base plate, on which a support tube stands vertically, and with a head member with a holding cone, on which corners of a false floor panel are placed. The foot member and the head member are connected in such a way by screw elements, that a desired height of the false-floor support can be adjusted.

These false-floor supports exhibit disadvantages in the event that the bare floor is uneven. Then undesirable inclinations of the false-floor supports result. Due to the inclination of the holding cone the supported corners of the floor panels exhibit different heights a, wherefore irregular changes in height occur at the surface of the false floor.

A bothersome unevenness of the bare floor was initially corrected by outpouring the area of support of the foot member or by applying wedges below the foot member. However with this measure, a sufficiently precise alignment of the false-floor supports could be reached only with considerable efforts.

For solving this problem, EP0309399A1 proposes a false-floor support that comprises a support dish with adjustable inclination that is provided with an enclosed spherically domed inner member, which can be clamped between a spherically-domed ring-dish and a spherically-domed pressure plate after the inclination has been adjusted.

EP0479720A1 discloses the false-floor support shown below in FIG. 1. This false-floor support comprises a foot member 220 with a base plate 221, which via a connection device 223 is elastically connected to a foot tube 222, which can vertically be aligned to the base plate 221. The foot tube 222 can therefore be inclined by a specific angle relative to the base plate 221, in order to compensate the unevenness of the floor. In the event that a larger unevenness cannot be compensated by means of the connection device 223, a pedestal 310 is provided below the base plate 221. A head tube 212, which comprises a head member 210 with a head plate 211, is telescopically entered into the foot tube 222. The head member 210, which is supported by a spring 230, is movable towards the foot member 220 until a screw stop 240, which is connected to the head tube 212 contacts the foot tube 222. The screw stop 240 is held by a thread and can be set to a desired height.

Known installations of a false floor are done step-by-step, floor panel by floor panel. I.e., when installing the false floor, false-floor supports are sequentially mounted and adjusted. Afterwards floor panels are mounted. After mounting each floor panel the alignment is measured with a water-level and the false-floor support is adjusted. In this way, the false floor is extended step-by-step, whereby the individual steps of mounting a floor panel and adjusting a false-floor support are repeated alternatingly. In total a considerable installation effort results. It must further be noted that the floor panels are typically removed again after the false floor has been installed, so that the concerned personnel can install media lines, e.g. electrical cables, on the bare floor. After installing the media lines the floor panels are mounted on the false-floor supports again, whereafter additional adjustments are often required.

EP0479720A1 further discloses a method for installing false floors with floor panels that are arranged alongside one another in rows and that are supported by adjustable false-floor supports, which are placed in a regular grid pattern on the bare floor. With this method an auxiliary plane is levelled in a desired distance or in a predefined height above a section of the bare floor which comprises several grid intersections. Afterwards the false-floor supports are placed onto the grid intersections between the auxiliary plane and the bare floor and set onto the predefined height and fixed. Then the floor panels are mounted on the fixed false-floor supports.

In contrast thereto, in JP2002089022 it is proposed to mount a beam consisting of two rail elements by means of false-floor supports. The false-floor supports comprise each a massive head member, which by means of a screw nut is vertically movable along a threaded shaft of a foot member and is connectable by means of screws with rail elements fitted on both sides.

From said documents it can be derived, that the known false-floor supports have a complex design required for compensating an unevenness of the bare floor in view of height and inclination. However, not only the construction of the false-floor supports requires efforts, but also the adjustment, in order to compensate unevenness, bothersome differences in elevation and inclinations of the bare floor at the installation sites. In the event that false-floor supports get shifted laterally, then readjustments are required. In the event that an earthquake should occur it is likely, that the false-floor supports shift under the load of the room installations due to vibrations and oscillations. Afterwards differences in elevation of the floor panels need to be corrected with significant effort.

SUMMARY OF THE INVENTION

The present invention is therefore based on the object of providing an improved false floor as well as a method and a device for the installation of the false floor, with which the above described deficiencies are avoided.

Particularly a method shall be provided that allows to install a false floor quickly and precisely with minimal effort and independently of the unevenness of the bare floor.

For the inventive false floor false-floor supports with a simple design shall be usable. Adjustments of the false-floor supports shall not be necessary.

It shall be possible, to create the false floor with high precision and low-cost. Further the false floor shall be immune against mechanical impacts and vibrations so that adjustments after the installation shall also not be required.

It shall be possible to rapidly install and uninstall the false floor. In particular, the exchange of the false floor, e.g. if required with a change in elevation, shall be possible with minimal time and effort.

The method and the device serve for the installation of a false floor above a bare floor. The false floor comprises false-floor supports, which are placed preferably in a regular grid pattern on the bare floor and on which floor panels are arranged alongside one another in rows.

According to the invention, mounting positions are determined for the false-floor supports and the false-floor supports to be installed are correspondingly positioned. Furthermore, a mounting plane lying at a mounting height is at least partially determined preferably by using laser devices. The false-floor supports to be installed are then positioned relative to the mounting plane. Pedestals, which are composed of solidifying pedestal material that is binding to the bare floor and which project beyond the mounting plane, are provided at the mounting positions before, during or after the positioning of the false-floor supports. The false-floor supports are then held each in the respective pedestal until the latter has solidified.

In the event that the floor panels were not already connected to the false-floor supports, then the floor panels are mounted on the false-floor supports after the solidification of the pedestals.

Since the false-floor supports are all on the same height in a horizontal mounting plane, adjustment is not required. Consequently, simply designed false-floor supports can be used, which in the simplest embodiment consist of a hollow cylindrical or rectangular tube. One end of the tube forms the foot member and the other end forms the head member of the false-floor support. If the diameter of the tube is sufficiently large and the false-floor supports are precisely positioned, then the corners of four floor panels can be seated on the tube. The false-floor support can also comprise a foot member with such a tube and a head member, e.g. a round or quadratic plate. Preferably, identical false-floor supports are used that are made from metal or plastic.

The false-floor support can consist of one part or a plurality of parts. It is of particular advantage to use a false-floor support with a foot member that is inserted into a pedestal, whereafter a suitable head member is mounted, e.g. in order to adjust the height of the false floor. Furthermore, the false floor can completely be uninstalled in a very short time and reinstalled again. For a renovation of a room the false floor can be removed with the exception of the remaining foot members. Afterwards the equipment required for the renovation can be moved into the room.

E.g., the false-floor supports are made from iron sheet with round or polygonal cross-sections. E.g., a part of an iron sheet is cut out and partitioned in four sections, which are then bent step-by-step by 90° against one another. In order to firmly anchor the false-floor supports in the pedestals, the foot member is preferably provided with anchor elements that are cut out of the iron sheet and are bent to the outside.

The inventive method can be executed in several variations, as individually desired by the user, wherein specific method steps may be interchanged.

The mounting positions for the false-floor supports can be determined sequentially or in groups. The pedestals can also be created sequentially or in groups. The false-floor supports, which consist of one or more parts, can also be inserted into the pedestals sequentially or in groups. A plurality of false-floor supports, preferably four, can already be connected to a floor panel, so that the false-floor supports can be positioned together with the floor panels. The mounting plane can also be selected in such a way, that the mounting plane lies on the height of the plane, in which the installed floor panels will be arranged. In this way the floor panels can be aligned with their upper edge with the mounting plane.

The pedestal material used for creating the pedestals is preferably filled into a structural member, which determines the final form of the pedestal and which prevents the pedestal material from being displaced when the false-floor supports are inserted. The structural member, e.g. a conically shaped, thin-walled tubular member, is preferably made from plastic or iron sheet. The conical shape allows stapling of the structural members and removal after solidification of the pedestals so that they can further be used. Furthermore, reinforcement elements made from metal or plastic can be provided.

Alternatively, the pedestal material used for creating the pedestals can be filled into containers, such as bags or bellows that are individually attached to the foot members of each false-floor support and that are preferably flexible. E.g., the container adjoins the foot member in such a way that the pedestal material can be filled through the false-floor support into the container. Infilling of the pedestal material can be done immediately before mounting the false-floor supports or the floor panels, so that the pedestal material can harden within a few minutes, without adding an activator. Alternatively, an activator can be added, e.g. if the pedestal material had been filled earlier into the container. Alternatively, it is also possible that the hardening of the pedestal material is done after the removal of the container, e.g. by exposing the pedestal to air or heat.

The pedestal material used for creating the pedestals is for example a concrete mix, a concrete for floors, a cement mix or a plaster, which is composed and applied in such a way that it solidifies only after a timespan, in which the false-floor supports have been inserted. It is further possible to apply means or energy, e.g. heating the pedestals, in order to accelerate solidification. Said materials exhibit the advantage, that they quickly get bound to the bare floor. However, the inventive method also allows placing false-floor supports in groups and holding the false-floor supports until the pedestals are solidified.

According to the invention the dimensions of the pedestals are created preferably uniformly in such a way that even the false-floor support at the lowest mounting position can be inserted with the required penetration depth into the pedestals. If the bare floor is substantially even, then smaller pedestals can be provided, which allow secure holding of the false-floor supports at even height. By examining or measuring the bare floor the use of the material can be optimized.

For the installation of the false-floor supports an inventive installation device can advantageously be used. The installation device comprises a holding device with a device grid arranged in a device plane that corresponds to the mounting grid and that exhibits two or more device positions where coupling devices are mounted, which serve for holding false-floor supports.

After fixing the false-floor supports on the holding device, the holding device is aligned with its device plane in parallel or congruent to the reference plane and lowered towards the mounting plane until the lower ends of the false-floor supports reach the mounting plane.

Thereby pedestals are prepared with pedestal material that is not solidified before positioning the false-floor supports or after positioning the false-floor support. It is particularly advantageous to prepare the pedestals after the positioning the false-floor supports. Thereby the requirement of determining mounting positions on the bare floor, where pedestals would be prepared before, is avoided. The mounting positions are determined by alignment of the false-floor supports e.g. in a grid pattern with a grid distance of 60 cm. After lowering the false-floor supports preferably vertically the positions of the pedestals are determined. Now, the pedestals can be built in a simple manner by providing a structural member each at the positions of the false-floor supports. This task can be executed particularly simple by coupling the structural members to the false-floor supports so that the false-floor supports and the structural members can be lowered together towards the bare floor after positioning of the false-floor supports. In this way, the structural members and hence the pedestals are always at the correct position without additional effort. The releasable connection or coupling of the structural member to the false-floor support is executed preferably by means of at least one clamp element, which is inserted in addition or is formed on the false-floor support or the structural member. Preferably, the structural member and the at least one clamp element, as well as the false-floor support, are preferably formed from an iron-sheet.

Shifting the false-floor supports into the mounting positions can be done in two different alternatives. In the first alternative the holding device is shifted along a calculated distance. If the holding device is held by a plurality of supports that comprise each an identical drive device, e.g. a spindle drive, then it is sufficient to actuate each drive device in the same manner, so that the holding device is shifted always in alignment in parallel to the reference plane along the desired distance.

Alternatively, the holding device is shifted preferably in parallel to the reference plane until a mounting or reference plane is reached at a lower level. E.g., the holding device is provided with optical sensors, which capture the light of a laser system present in the reference plane and/or the mounting plane. Signals of these sensors allow a control system to adjust the holding device in the reference plane and/or the mounting plane or in a specific distance in parallel thereto.

The holding device is supported with at least three, preferably four lifting devices and is vertically movable with these lifting devices. E.g., the holding device is held by supports that are provided with drive devices, e.g. electric motors, which drive a spindle. The spindle is engaged in a bearing block that is connected to the holding device and that is vertically shifted upwards or downwards together with the holding device when the spindle is turned. Such spindle drives are available for example by maxon company (see maxonmotor.com). Any other preferably controllable lifting device, hydraulic and pneumatic lifting devices, can be used, which allow vertical shifting of the holding device.

After the installation, the lifting devices and/or the drive devices are preferably released from the holding device and used for another holding device, so that these devices need not be present in multiples.

DESCRIPTION OF THE DRAWINGS

Below, the invention is described with reference to the drawings.

FIG. 11 *b* shows a false-floor support with anchor elements;

FIG. 11 *c* shows the false-floor support held in the solidified pedestal, after removal of the beam-shaped element.

DETAILED DESCRIPTION OF THE INVENTION

Figures 1, 1A:
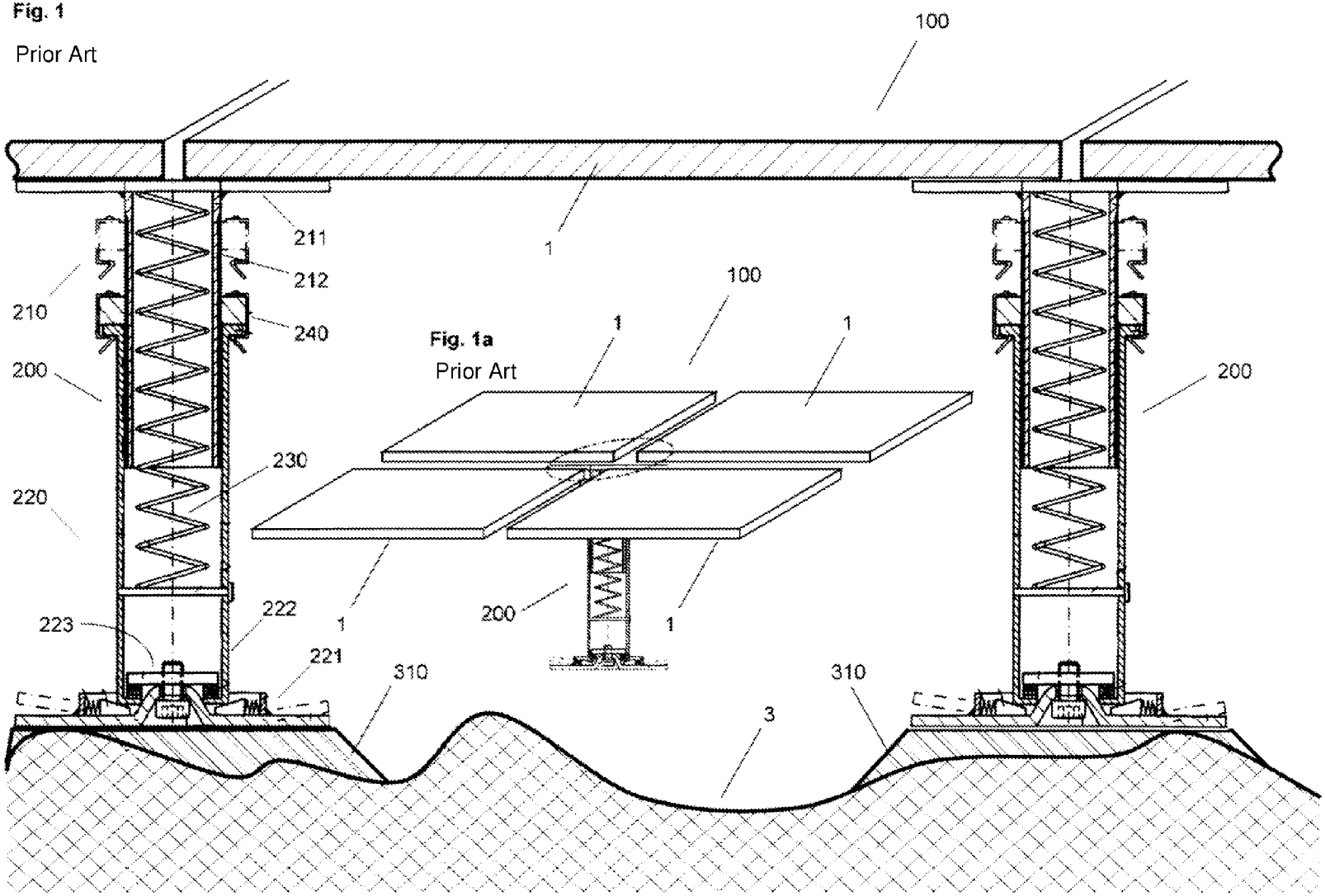
Fig. 1a Prior Art
Fig. 1 Prior Art
FIG. 1 shows the prior art false floor described above, which comprises adjustable false-floor supports that support the floor panels.
FIG. 1*a* shows a false-floor support of FIG. 1, which supports the corners of four floor panels.

FIG. 1 shows the prior art false floor 100, which has been described above and which comprises adjustable false-floor supports 200 which support the floor panels 1. FIG. 1*a* shows the false-floor support 200 of FIG. 1, which supports the corners of four floor panels 1 of the false floor 100.

Figure 2:
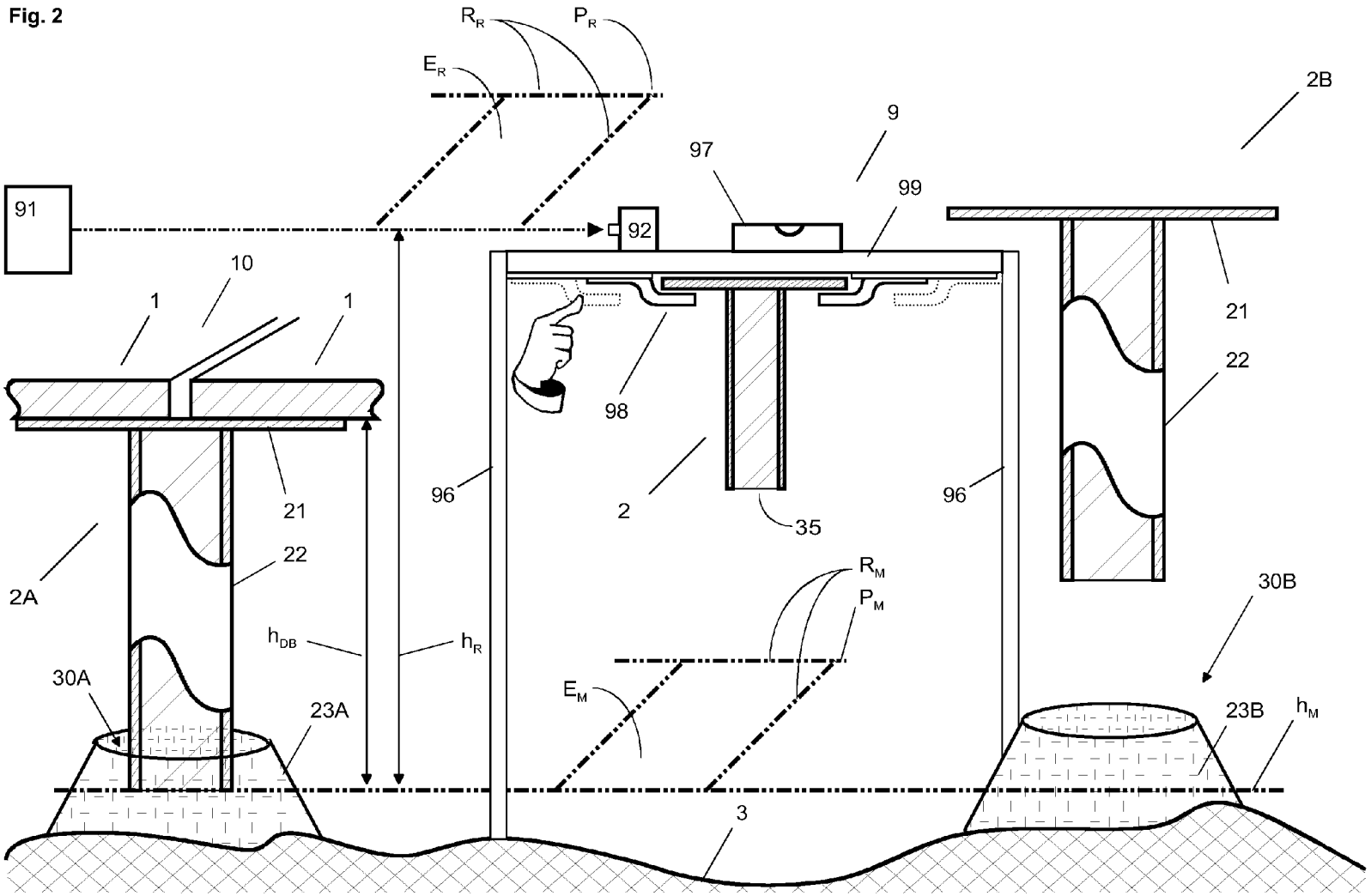
FIG. 2 shows a part of an inventive false floor with an inventive false-floor support installed in a pedestal as well as a simple inventive installation device in schematic illustration.

FIG. 2 shows a part of an inventive false floor 10 with a false-floor support 2A installed according to the invention, which supports four floor panels 1 in the manner shown in FIG. 1*a*.

Use of the inventive method, which is described below, allows mounting of all false-floor supports 2A, 2B with little effort at the same height $h_M$ in a mounting plane $E_M$ above the bare floor 3.

For this purpose, mounting positions 30A; 30B; . . . for the false-floor supports 2 are determined on the bare floor 3. This can be done precisely with a laser system, which forms a grid pattern, whose intersection points $P_R$ indicate the mounting positions 30A; 30B; . . . .

At the mounting position 30A; 30B; . . . pedestals 23 are provided that consist of pedestal material that is solidifying and bonding onto the bare floor 3.

Subsequently, preferably by means of laser devices 91, at least a part of a reference grid $R_R$ is created that lies in a horizontal reference plane $E_R$, whereby at least one mounting plane $E_M$ is partly defined, which lies in a selected distance d in parallel thereto on a mounting height $h_M$. The mounting plane $E_M$ intersects the pedestals 23 at the mounting height $h_M$, which is selected in such a way that the false-floor supports 2, which are inserted down to the mounting plane $E_M$, are securely held in each pedestal 23.

In a further installation step the false-floor supports are inserted from above at least approximately vertical into the pedestals 23 that are not yet solidified, until the lower end of the false-floor support 2 lies at least approximately at the level of the mounting height $h_M$.

The false-floor supports 2 are then held each in a related pedestal 23, until this pedestal 23 has hardened, whereafter the holding device 99 is removed. Subsequently the floor panels 1 mounted.

The false-floor supports 2, which are made preferably from metal or plastic, can have a simple design and comprise in the shown embodiment a tubular foot member 22 and a head member 21 in the a form of a head plate. The false-floor support 2 does not require an adjustment device. Only in preferred embodiments two-part false-floor supports 2 are provided that are adjustable.

The length or height the false-floor supports 2 corresponds to the difference of the height $h_M$ of the at least one mounting plane $E_M$ to the height $h_{DB}$ of the false floor 10 (the height $h_{DB}$ is measured at the lower side of the floor panels 1). By selecting false-floor supports 2 with a specific height or by stepwise adjustment of the false-floor supports 2 the height the false floor 10 can be selected. This is of particular advantage in the event that a new false floor 10 shall be installed at a different height $h_{DB}$, when a renovation or restoration is performed.

FIG. 2 shows that the false-floor supports 2 are positioned with the precision of the laser-device 91 and are firmly held in the pedestal 23. Hence, in principle, a head plate 21 is not required. The corners of the floor panels 1 can securely be mounted on a tube that exhibits a corresponding diameter. Even under massive mechanical impacts, shifting of the false-floor supports 2 is practically excluded, wherefore the inventive false floor 10 can advantageously be installed in areas, where earthquakes may occur.

FIG. 2 shows a simply designed installation device 9, which comprises, besides a preferably used laser device 91, also sensors 92 that provide a sensor signal, as soon as a laser beam is captured. The installation device 9 comprises a holding device 99 with which a false-floor support 2 or a group of false-floor supports 2A, 2B, . . . can be held and aligned in a reference plane $E_R$ or a reference grid $R_R$ and can be driven towards the mounting plane $E_M$.

With the laser device 91 a reference grid $R_R$ with intersection points $P_R$ is created at a height $h_R$, vertically below which intersection points $P_R$ mounting positions 30 are marked on the bare floor 3. The reference grid $R_R$ serves further for the alignment of the holding device 99, on which at least one optical sensor 92 is provided, which indicates reaching the reference plane $E_R$ and correct alignment within the reference plane $E_R$.

The holding device 99 comprises coupling devices 98 at the lower side, with which false-floor supports 2 can be attached vertically aligned to the holding device 99. In the embodiment shown, the coupling devices 98 comprise individual grafters or a common grafter that can be shifted over the head members of the false-floor supports 2, in order to fix the false-floor supports 2. The false-floor supports 2 are held for example by flange elements 981 that are mounted on the holding device 99. Hence, the false-floor supports 2 can be inserted and fixed in the flange elements 981 in a simple manner. FIG. 8 and FIG. 9 show instead of a grafter a clamp device, with which each false-floor support 2 can be fixed by manually operating a lever.

FIG. 2 shows further that the holding device 99 can be adjusted in height and can be aligned horizontally in the reference plane $E_R$ by means of laser devices 91, 92 or by means of a water-level and further measurement instruments, particularly optical measurement instruments.

The holding device 99 forms a frame with longitudinal bars and transversal bars, preferably rectangular pipes, which are aligned in a plane, namely the device plane $E_V$, corresponding to the reference grid $R_R$. The mutual distance of the crossing points of the longitudinal bars and transversal bars corresponds thereby to the mutual distance of the mounting positions 30A, 30B of the false-floor supports on the bare floor 3. In the event that an installation company installs floor panels with different dimensions, then the distance between the crossing points of the longitudinal bars and transversal bars is preferably adjustable. For this purpose preferably longitudinal bars and transversal bars are used, which can be shifted telescopically into one another or can be connected with one another in different grid distances.

Figure 3:
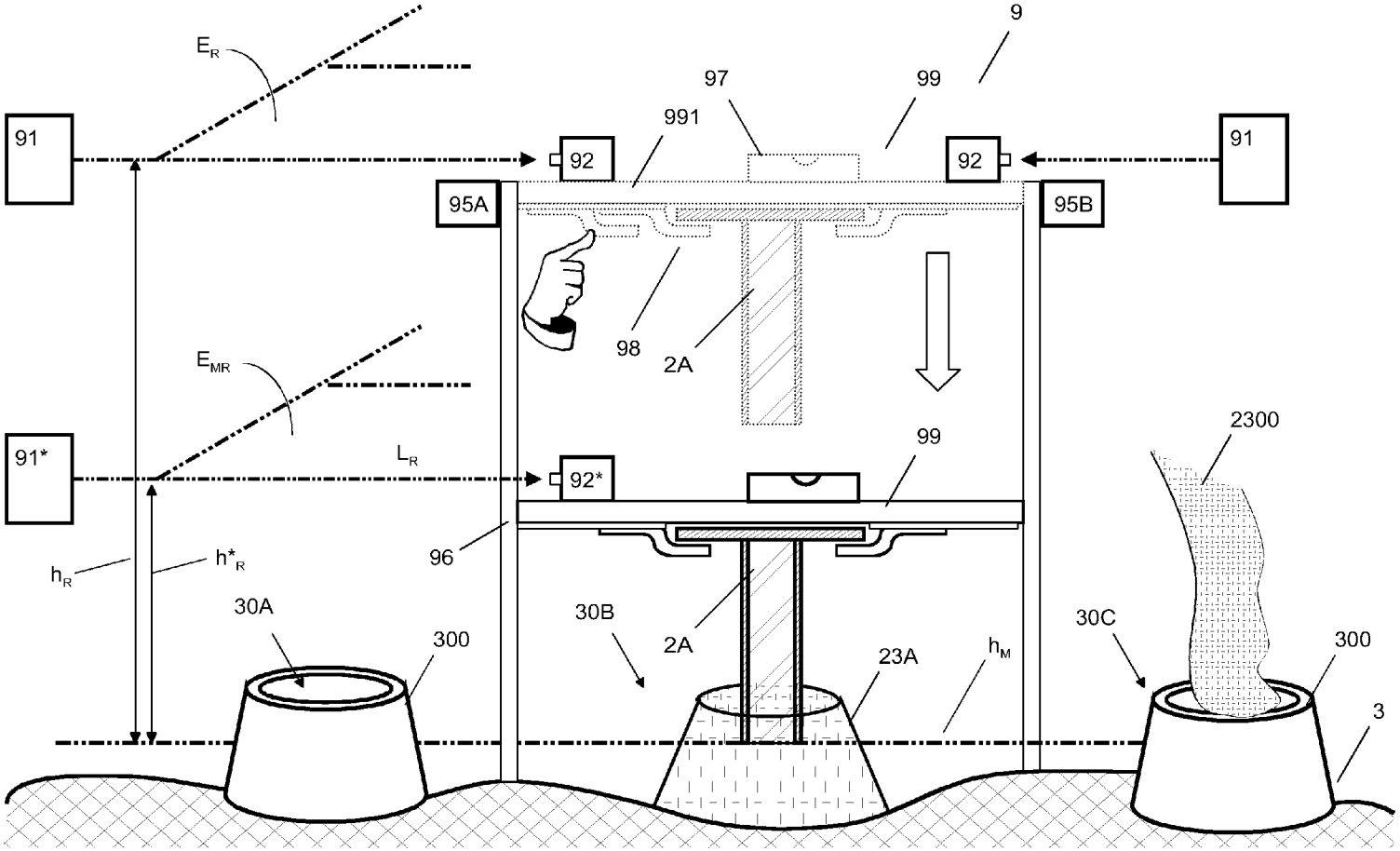
FIG. 3 shows the creation of a pedestal, as well as the operation of the installation device of FIG. 2.

FIG. 3 illustrates two different options of operating the installation device 9 of FIG. 2.

With the first option the holding device 99 with the device plane $E_V$ is aligned in parallel or congruent to the reference plane $E_R$. After alignment of the holding device 99 in the reference plane $E_R$ or parallel to the reference plane $E_R$ a vertical movement is performed over a predetermined distance $d_M$ in parallel towards the mounting plane $E_M$. The distance $d_M$ is selected in such a way, that after traversing the distance $d_M$ the lower ends of the false-floor supports 2 reach the mounting plane $E_M$ and lie at the mounting height $h_M$. Precise traversal of the distance $d_M$ can be performed in several ways. Movements of the holding device 99 can be measured and controlled. Sensors and end stops can be provided, which indicate the traversal of the distance $d_M$, in order to stop the drive devices 95, or to block a further movement. Further, it can be arranged that the manually or electrically operated drive devices 95 can perform only a predetermined number of steps or turns, which correspond to the distance $d_M$. If the drive devices 95 each comprise a stepper motor, then this stepper motor is controlled accordingly.

Alternatively, the holding device 99 with the device plane $E_V$ is aligned preferably horizontally, if appropriate in parallel or congruent to the reference plane $E_R$ and then moved towards the mounting plane $E_M$, until one or a plurality of sensors 92; 92A, . . . indicate reaching of a mounting or reference plane $E_{MR}$, which is selected in such a way that the lower ends of the false-floor supports 2 are at the height $h_M$ of the mounting plane $E_M$, when the sensors 92; 92A, . . . are activated. In principle it is sufficient, when a laser device or, more general, a line generator is provided as a reference for reaching the mounting or reference plane $E_{MR}$. Since the pedestals 23 are not solidified when the false-floor supports 2 are entered, only one reference line $R_L$ can be provided and the horizontal alignment of the holding device 99 can be examined and corrected again when the reference line $R_L$ is reached.

FIG. 3 shows a further preferred option for creating the pedestals 23. In this option a structural member 300 is provided at each mounting position 30A, 30B, . . . , and is filled with pedestal material 2300 that is used for creating the pedestals 23, such as a concrete mix, concrete for floors, a cement mix or a plaster. The structural member 300 shown comprises the form of a conically shaped tube, through which the pedestal material 2300 is transferred to the bare floor 3 so that it is laterally held and pedestals 23 in the form of a cake are obtained. After hardening of the pedestal 23 the structural members 300 are preferably removed and reused.

Figure 4:
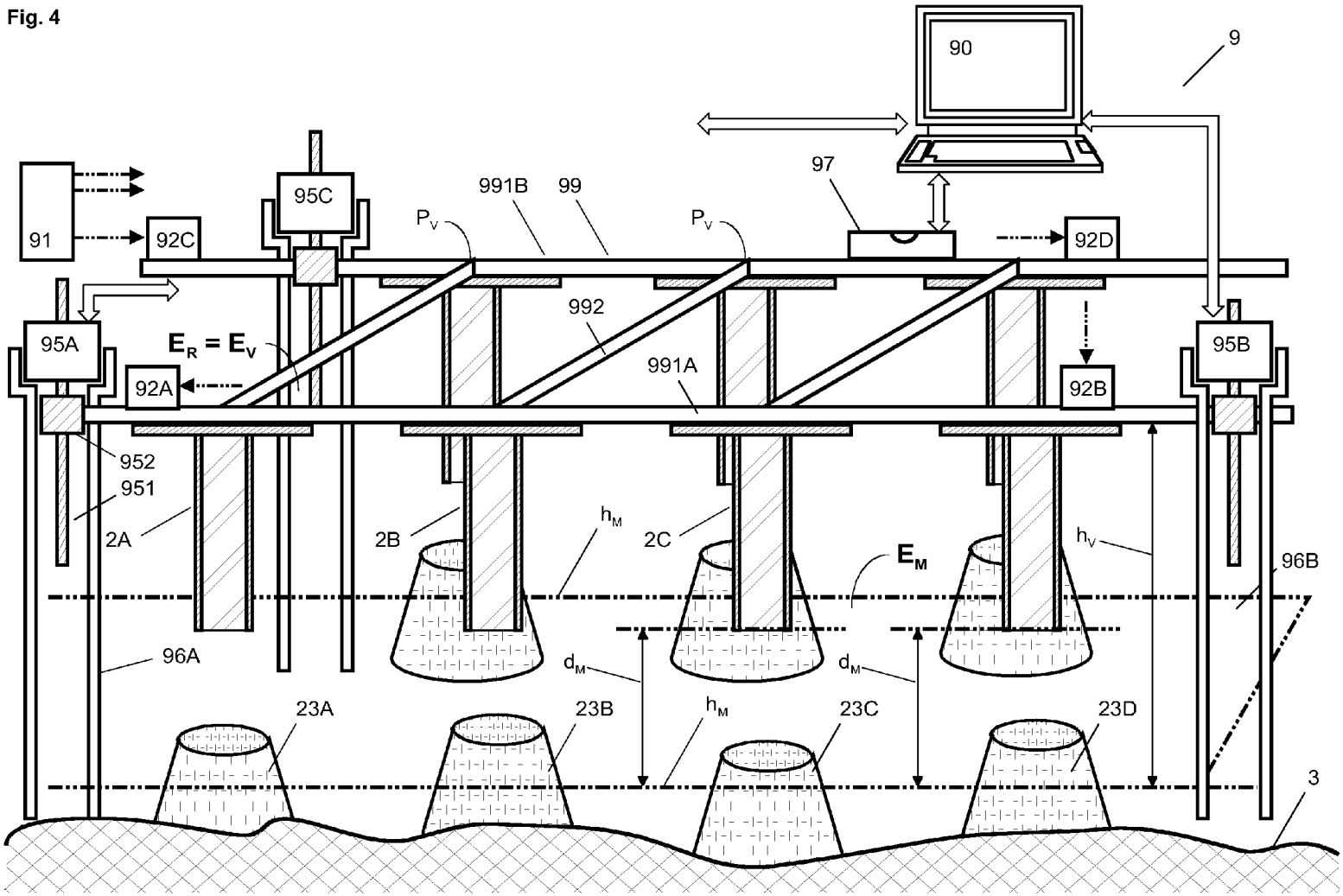
FIG. 4 shows an inventive installation device with which false-floor supports can be inserted in groups by means of lifting devices precisely into prefabricated pedestals.

FIG. 4 shows an inventive installation device 9, with which the false-floor supports 2 can be entered in groups by means of lifting devices 95, 96 and a holding device 99 at the exact positions into prefabricated pedestals 23.

The lifting devices 95, 96 comprise each a support 96, with which a spindle drive 95 is held at constant height. For each lifting device 95, 96 the holding device 99, which comprises a frame structure with longitudinal bars 991 and transversal bars 992, comprises a bearing block 952, in which the spindle 951 of the drive device 95 is entered. With each turn of the spindle 951, the related bearing block 952 and therefore the holding device 99 is shifted upwards or downwards, depending on the turning direction. Hence, each lifting device 95, 96 is connected via a spindle 951 and a bearing block 952 with the holding device 99 and can be released therefrom in a simple manner. For this purpose the spindle 951 is turned, until the bearing block 952 is released. Hence, the lifting devices 95, 96 can be used for adjusting and moving the holding device 99 and can then be released and used with a further holding device 99.

FIG. 4 shows that the installation device 9 can be controlled and completely automated with a control unit 90. Processing of the signals of the sensors 92 and the measuring device 97 as well as controlling the drive units 95 can be done e.g. with a notebook computer 90. Communication is performed preferably via a wireless network.

Figure 5:
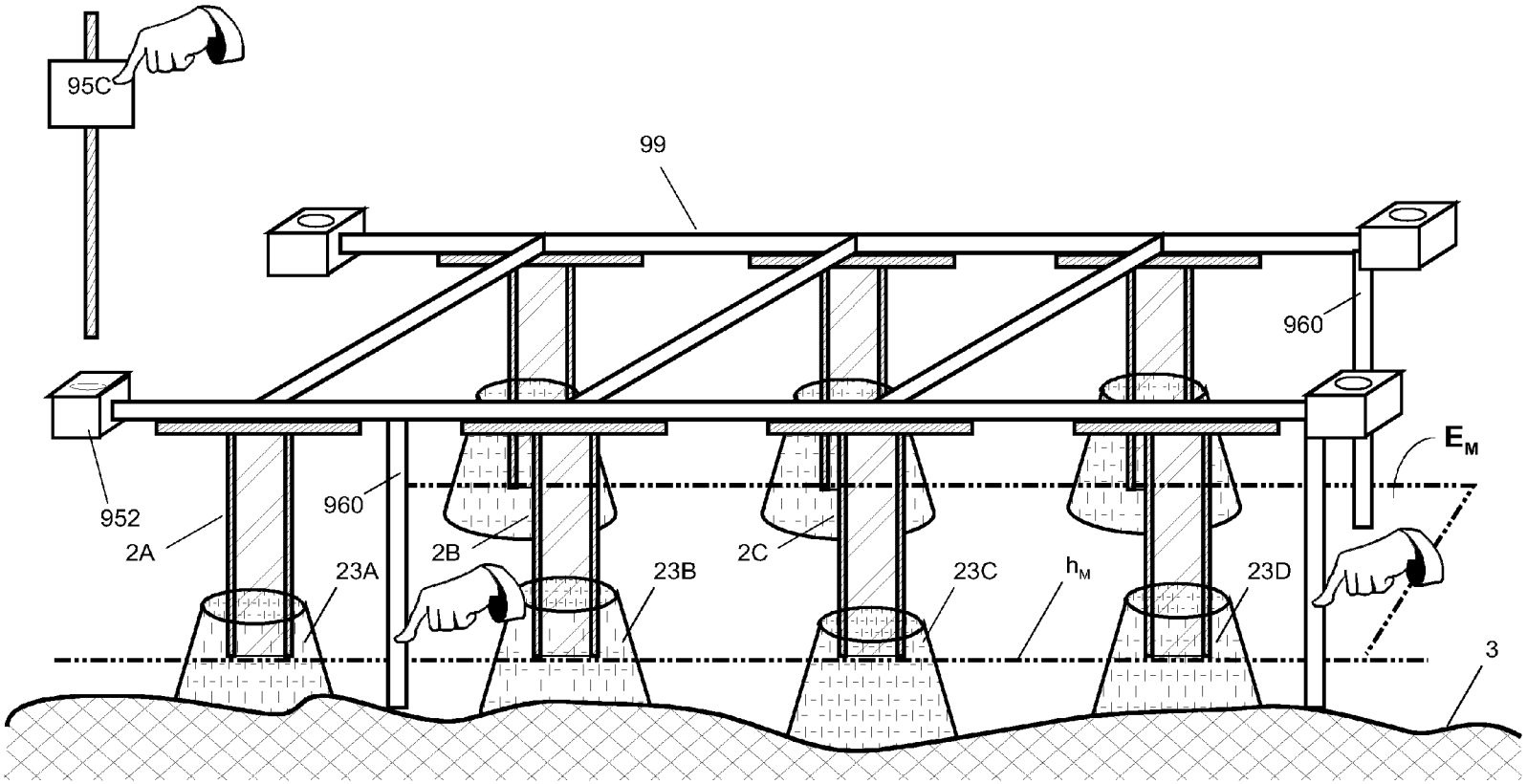
FIG. 5 shows the false-floor supports of FIG. 4 after insertion into the pedestals and the exchange of the lifting devices by auxiliary supports.

FIG. 5 shows the holding device 99 after the removal of the lifting devices 95, 96, which are used for the installation of a further holding device 99. In order to hold the holding device 99 in position until the pedestals 23 are solidified, it has been fixed by means of auxiliary supports 960, which are removed as soon as the pedestals 23 are solidified.

Figure 6:
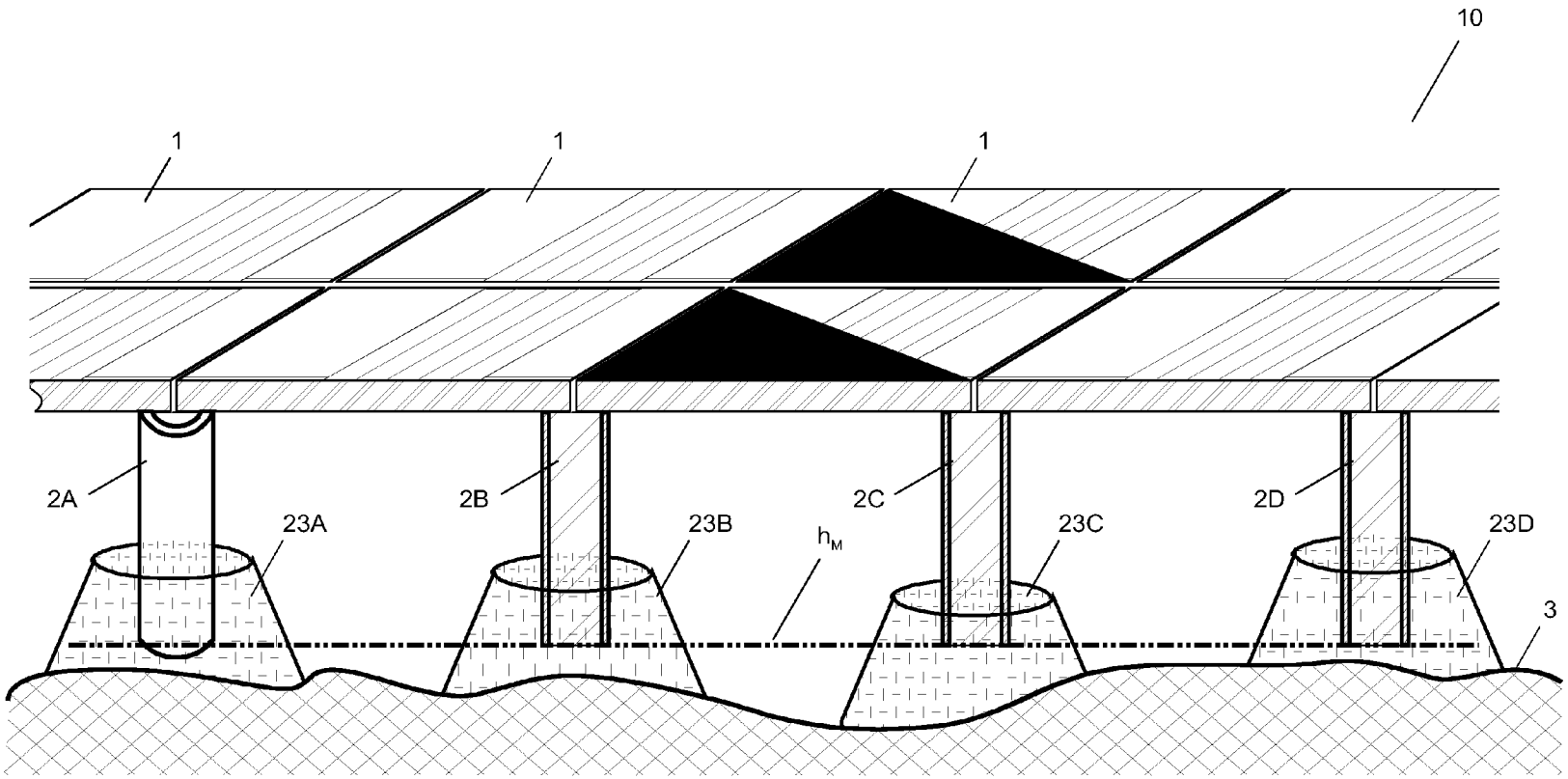
FIG. 6 shows the false-floor supports of FIG. 5 firmly installed in the solidified pedestals, on which false-floor supports floor panels have been mounted for creating the false floor.

FIG. 6 shows the false-floor supports 2 of FIG. 5 firmly installed in the solidified pedestals 23. On the false-floor supports 2 the floor panels 1 were amounted for creating the false floor 10. It is shown that the false-floor supports 2 can advantageously be round or polygonal pipes, which do not comprise a head plate. Due to precise mounting and precise alignment of the false-floor supports 2 pipes with small cross sections can be used. E.g., round pipes with a diameter in the range of 8 cm-16 cm or polygonal pipes with a side length in the range of 8 cm-16 cm and a material thickness in the range of 1.5-3 mm are used. Depending on the load and the length of the false-floor supports 2 deviating dimensions can be selected. Further, enforcing elements such as reinforcing seams can be integrated into the pipes, which enhance solidity. Further, preferably anchoring elements are provided in the foot region of the tubes, i.e. the false-floor supports 2, which hold the false-floor supports 2 firmly within the pedestals 23. For this purpose, grooves that are arranged like a thread can be provided in the foot member. The length of the false-floor supports 2 can be selected by the user in a wide range. E.g., a unitary length in the range of 8 cm-16 cm is selected.

It is also possible to adapt the method to a bare floor 3, which exhibits a gradient, e.g. steps. With adaptations of the installation device 9 a plurality of mounting planes $E_M$ can be provided and false-floor supports 2 with different lengths can be installed. E.g., the distance $d_M$ that needs to be traversed can be adapted to the selected mounting plane $E_M$ and to the selected length of the false-floor supports 2.

Figures 7, 7A, 7B, 7C:
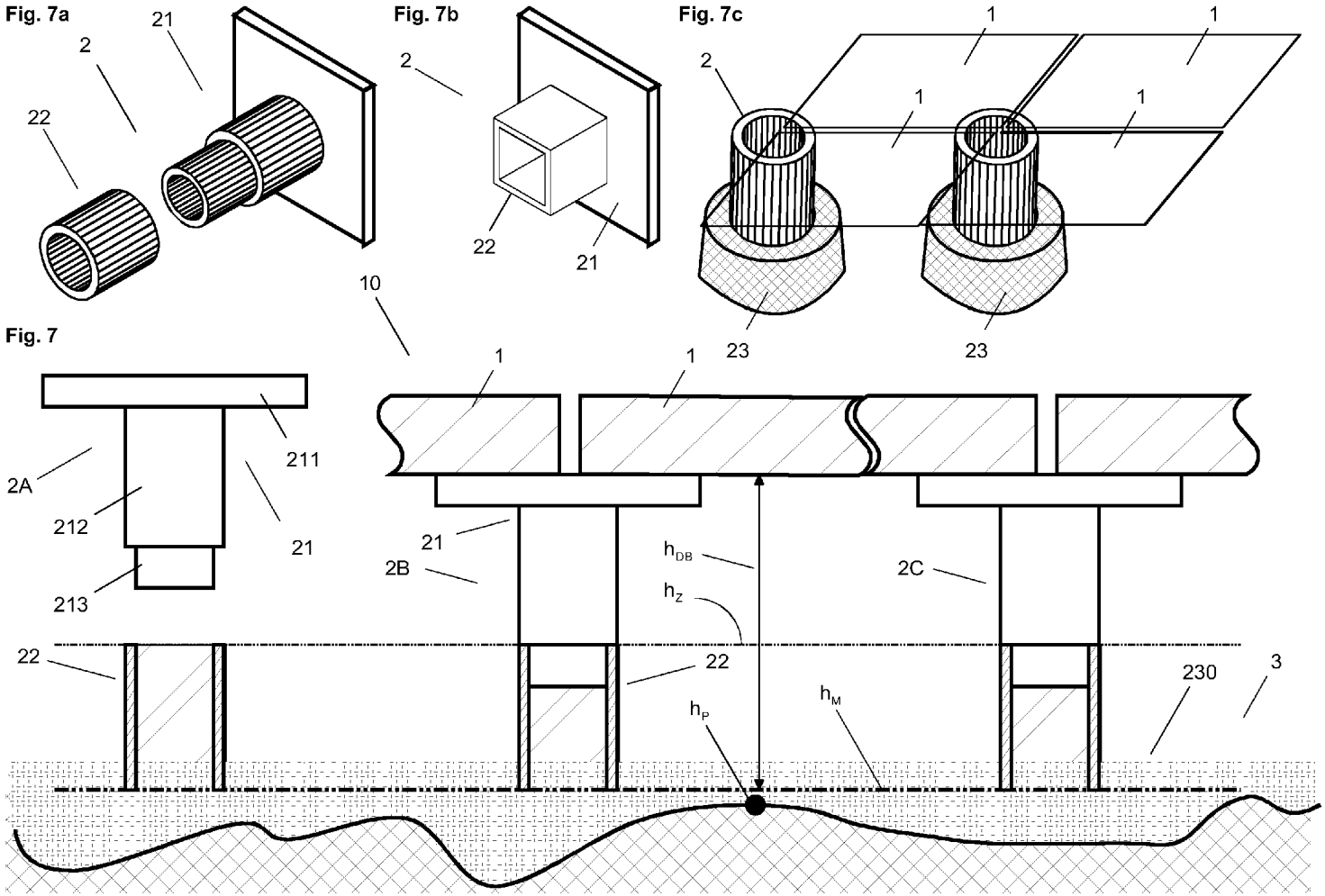
FIG. 7 shows a false floor with false-floor supports that consist of two parts and that are inserted in a common pedestal.
FIG. 7*a* shows a two-part false-floor support with two tubes that are movable into one another.
FIG. 7*b* shows a single-part false-floor support that comprises a head member and a foot member that has been prefabricated from rectangular pipes.
FIG. 7*c* shows false-floor supports in form of simple tubes that have been inserted into pedestals.

FIG. 7 shows an inventive false floor 10 with a plurality of two-part false-floor supports 2, which comprise each a foot member 22 held in a common pedestal 230 and a head member 21 serving for holding floor panels 1.

The height $h_M$ of the mounting plane $E_M$ within the common pedestal 230 lies above the height $h_P$ of the highest point of the bare floor 3. Hence, when lowering the false-floor supports 2 the bare floor 3 is not reached by them. This application is preferably then used, when the bare floor 3 needs to be covered anyway with an additional layer that can advantageously be used as a common pedestal 230. The false-floor supports 2 are inserted in the same way into the common pedestal 230, as this has been described for individual pedestals 23.

FIG. 7*a* shows a two-part false-floor support 2 with two tubes with a head member 21 and of a foot member 22 that can be inserted into one another.

FIG. 7*b* shows a one-part false-floor support 2 that comprises a foot member 22 in form of a rectangular pipe and a head member 21 in form of a plate. The rectangular pipe allows safe mounting of floor panels 1 even with a small cross section.

FIG. 7*c* shows in a three-dimensional view false-floor supports 2 which are simple round pipes.

Figure 8B:
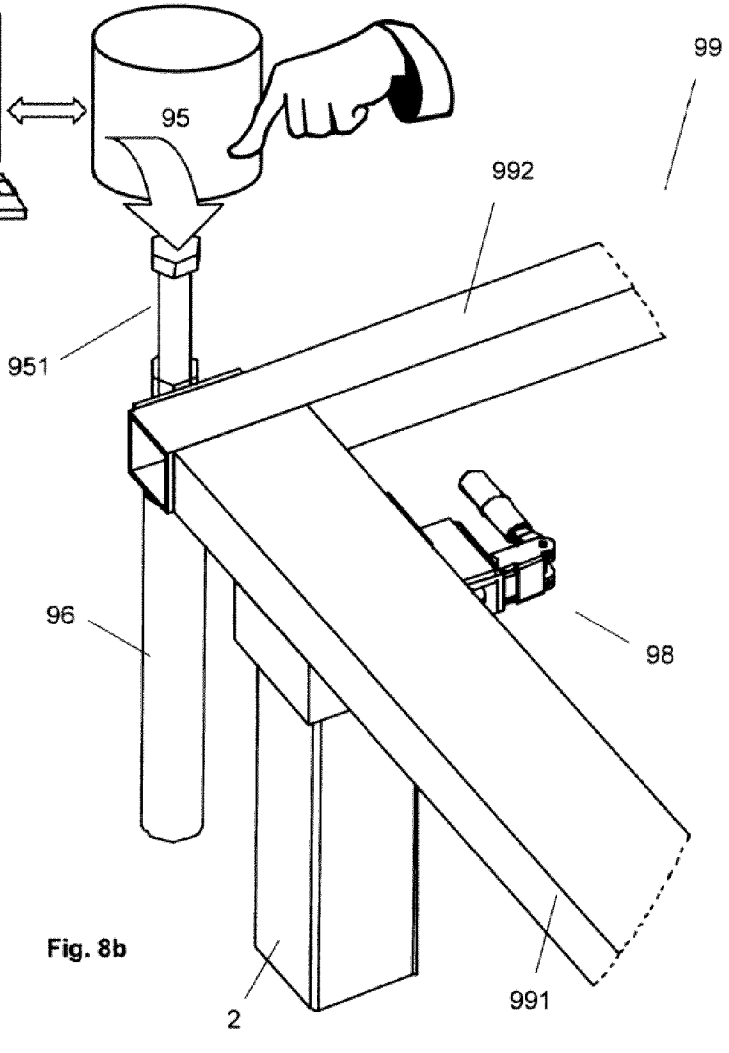
FIG. 8*b* shows the part of the holding device of FIG. 8*a* after fixing a false-floor support, with a lifting device that can be operated manually or with a drive device.
Figure 8A:
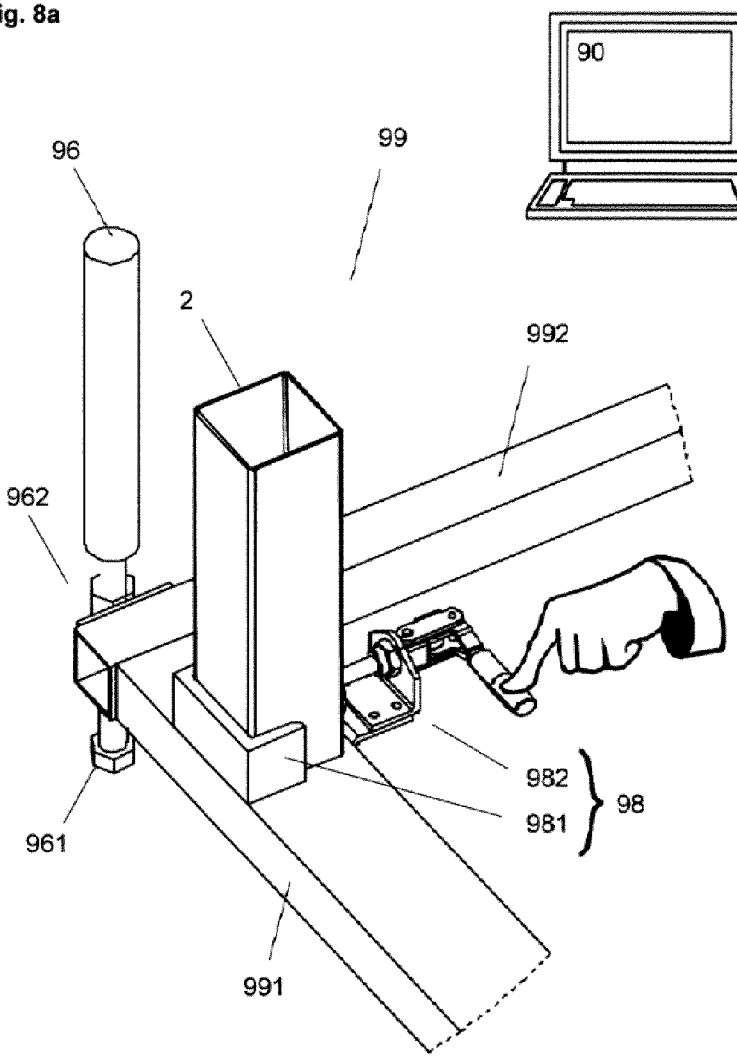
FIG. 8*a* shows a part of a holding device made of rectangular pipes with coupling devices, with which false-floor supports can be fixed with a movement by hand.

FIG. 8*a* shows from below a part of a holding device 99, consisting of rectangular pipes with a coupling device 98, with which a false-floor support 2 can be fixed by executing a single manual operation of a lever. The coupling device 98 comprises a U-profiled flange element 981, which is connected to the holding device 99 and into which a false-floor support 2 can be inserted in a form locking manner and can be fixed by means of the clamp 982.

FIG. 8*b* shows from above a part of the holding device 99 of FIG. 8*a* after fixing the false-floor supports 2, with a lifting device 96 that is operated manually or by means of a drive device 95. It is shown that a drive motor 95 is set up on a spindle 961, which is turned in order to vertically move the holding device 99.

Figures 9A, 9B:
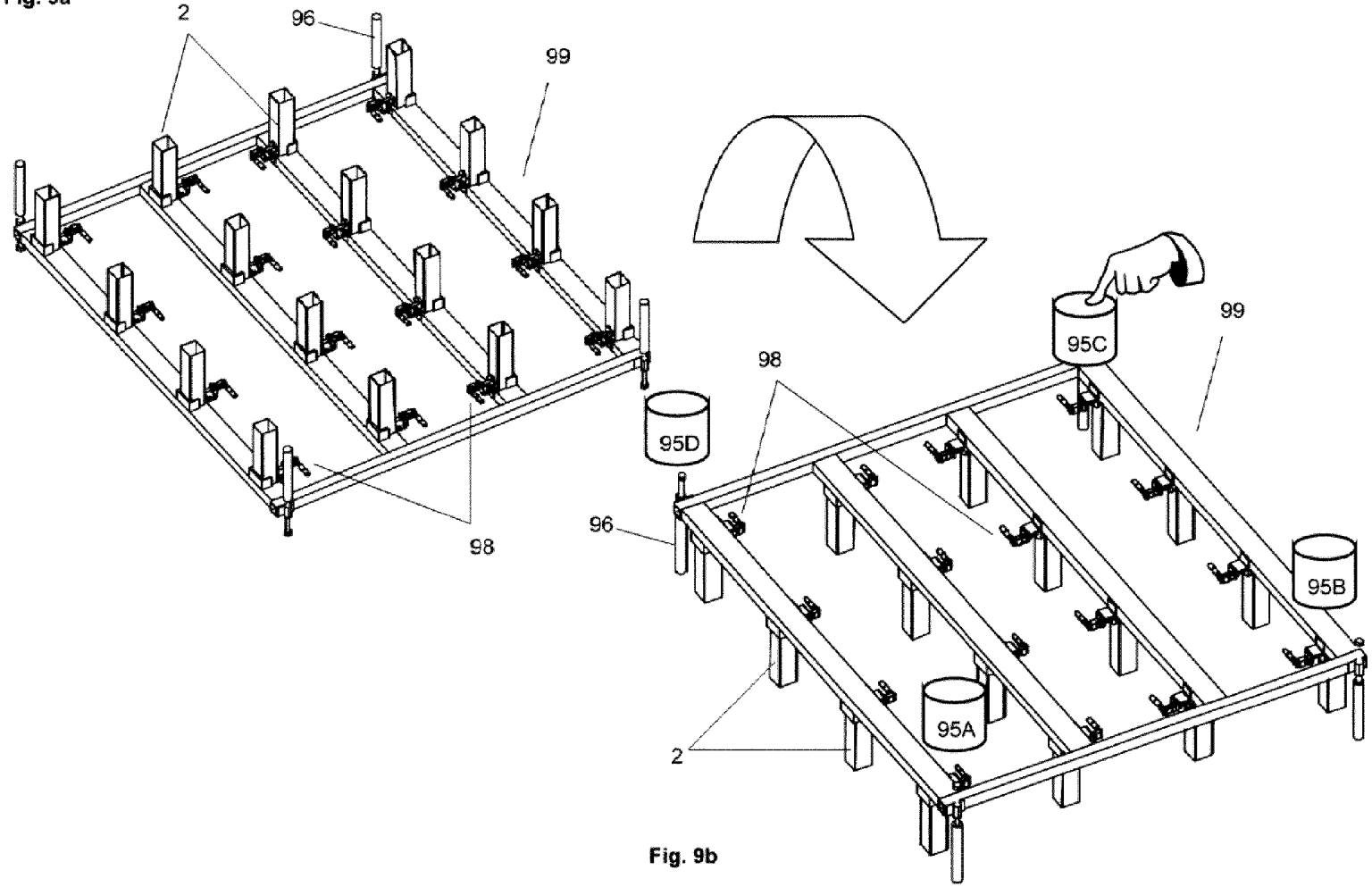
FIG. 9*a* shows the holding device of FIG. 8*a* after attaching 16 false-floor supports.
FIG. 9*b* shows the holding device of FIG. 9*a* with false-floor supports directed downwards towards the bare floor and four symbolically shown drive devices.

FIG. 9*a* shows the holding device 99 of FIG. 8*a* after fixing sixteen false-floor supports 2. For mounting the false-floor supports 2, the holding device 99 has been laid with the upper side onto the bare floor 3.

FIG. 9*b* shows the holding device 99 of FIG. 9*a* with the false-floor supports 2 directed towards the bare floor 3. Subsequently, the false-floor supports 2 are transferred into the pedestals 23 according to the inventive method.

Figure 10:
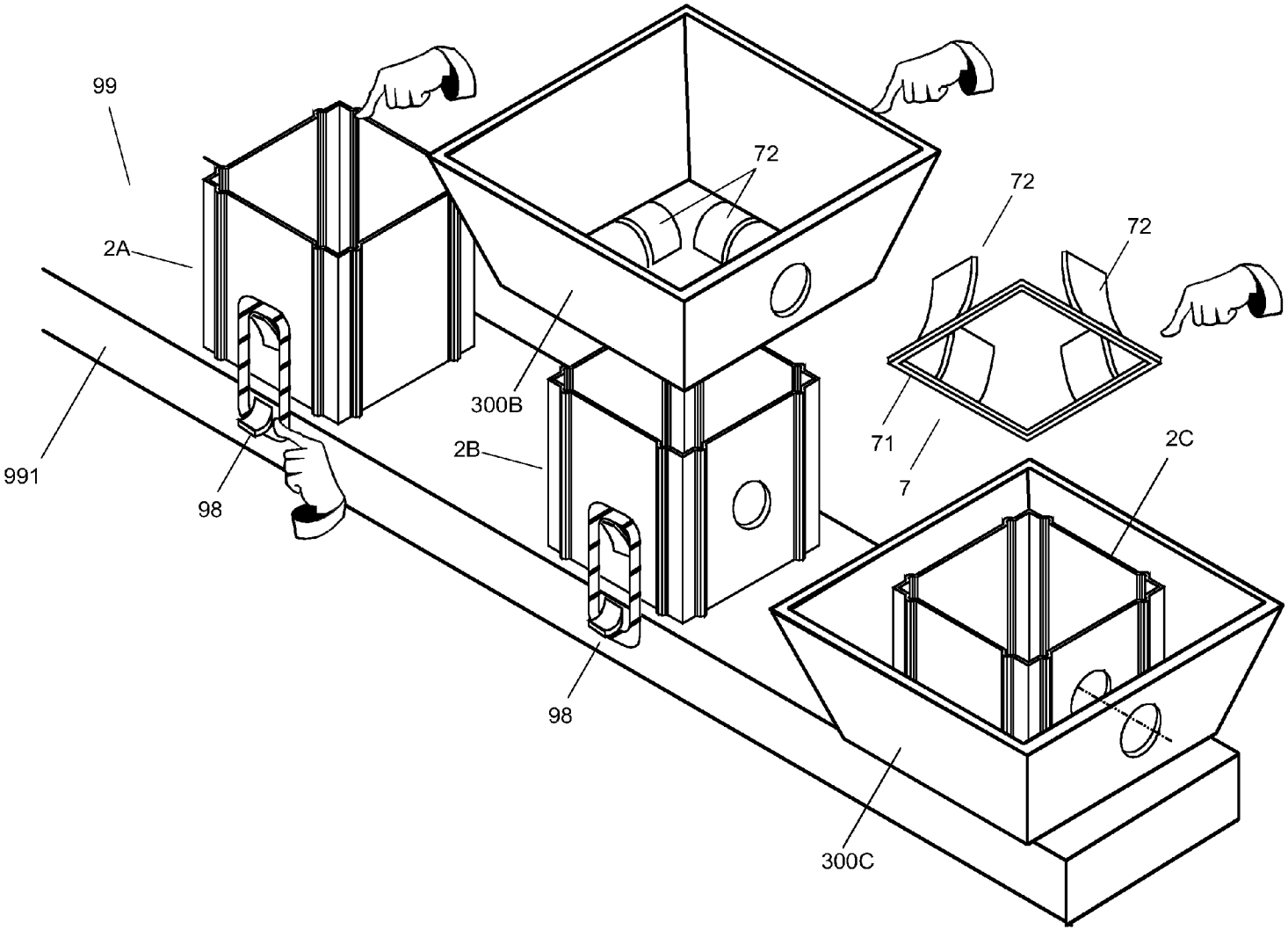
FIG. 10 shows the attachment of false-floor supports together with a structural member on a beam-shaped element of a holding device.
Figures 11A, 11B, 11C:
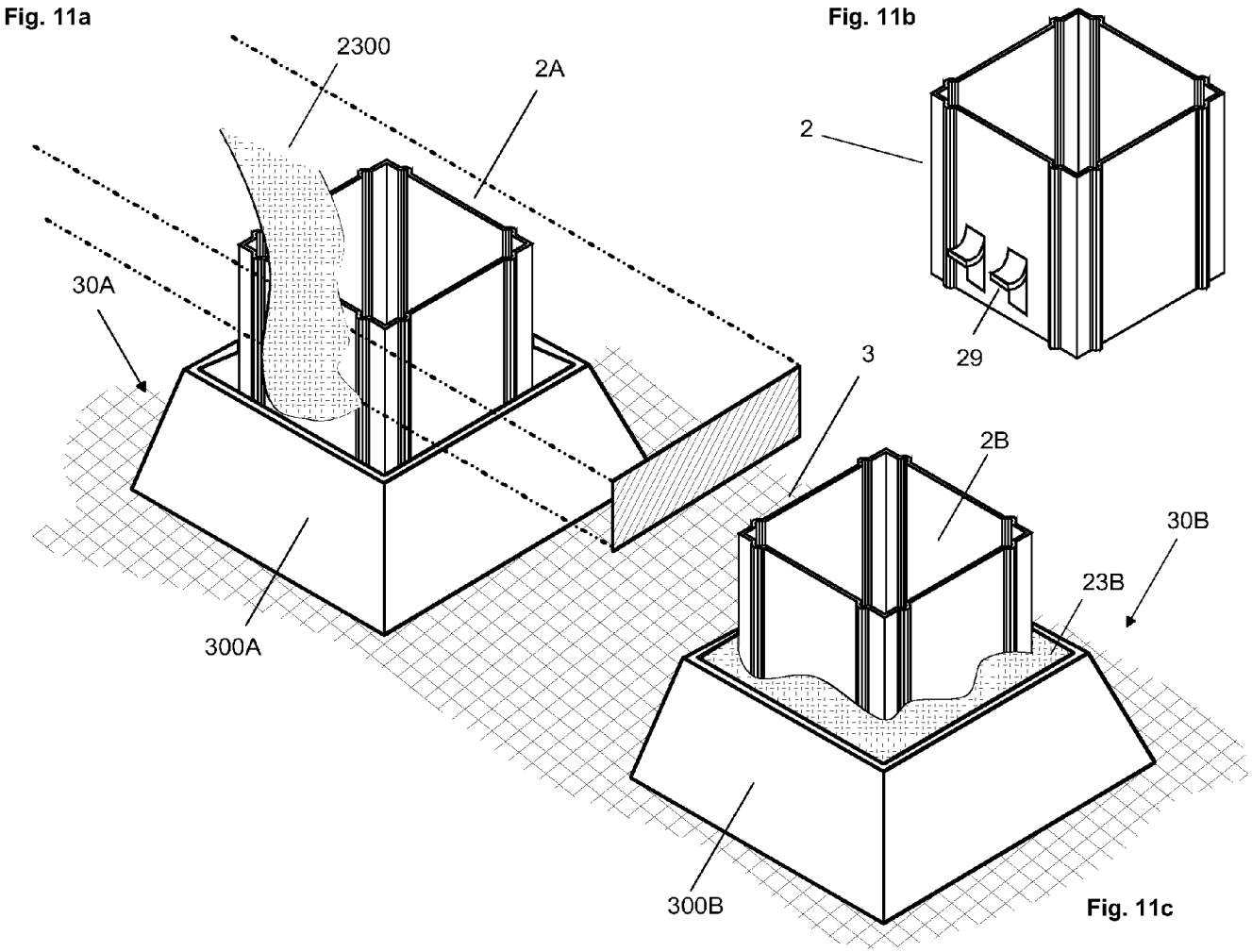
FIG. 11*a* shows infilling of pedestal material into the structural member, while the false-floor support is held by the beam-shaped element of the holding device.

FIGS. 10, 11*a* and 11*b* relate to a preferred option of the inventive installation method, which has also the object of anchoring all false-floor supports 2 at the same height within pedestals 23. With this option, the installation is performed with minimal effort.

FIG. 10 shows that the false-floor supports 2A, 2B, 2C are mounted by means of coupling devices 98 on a beam-shaped element 991 of a holding device 99. The coupling devices 98 comprise an elastic element, which can be connected to the beam-shaped element 991 and to the false-floor supports 2. E.g., a hook is cut out of the false-floor supports 2, in which the elastic element, e.g. a simple rubber ring, can be engaged. Further, the structural members 300 are guided over each false-floor support 2A, 2B, 2C and are fixed by means of clamp elements 7. The clamp elements 7 comprises tongues 72 which are adjoining the false-floor support 2 and which are mounted on a ring 71, which adjoins the structural member 300 and presses the structural member 300 against the beam 991. Hence, the beam 991 can be turned, without getting the mounted false-floor support 2 and the structural member 300 released. For the attachment of the structural members 300, the structural members 300 and the false-floor supports 2A, 2B, 2C can also be provided with openings facing one another, through which a bar-shaped locking element can be guided. After positioning the false-floor supports 2A, 2B, 2C the bar-shaped locking elements are removed so that the structural members 300 can be shifted against the bare floor. In preferred embodiments, centering elements can be provided, which can be part of the structural members 300 or the false-floor supports 2A, 2B, 2C, which hold the movable structural members 300 and the false-floor supports 2A, 2B, 2C in coaxial alignment.

Subsequently, the beam 991 is lowered as described above until the lower side of the false-floor supports 2A, 2B, 2C reach the mounting positions on the height of the mounting plane $E_M$. Then the structural members 300 are moved downwards until they reach the bare floor 3, as shown in FIG. 11*a* and FIG. 11*b*. It is shown that the cross-section of the false-floor supports 2A, 2B, 2C is smaller than the cross-section of the smaller one of the openings of the conically-shaped structural member 300, wherefore between the outer side of the false-floor supports 2A, 2B, 2C and the inner side of the structural member 300 space remains for infilling pedestal material 2300, e.g. a concrete mix. The false-floor supports 2A, 2B, 2C preferably comprise openings, which allow the liquid pedestal material to enter the false-floor supports 2A, 2B, 2C.

FIG. 11*a* shows infilling of pedestal material 2300 into the structural member 300A while the false-floor support 2A is still held by the beam-shaped element 991 of the holding device 99.

FIG. 11*b* shows a false-floor support 2 with anchor elements 29, which are designed to firmly hold the false-floor support 2 in the pedestal 23. Further, the false-floor support 2 comprises reinforcing seams that run in parallel close to the edges. With the reinforcing seams the stability of the false-floor support 2 is increased.

FIG. 11*c* shows the false-floor support 2B, which is held in the solidified pedestal 23B after the beam-shaped element 991 has been removed.

In a preferred embodiment the holding device 99 is installed stepwise in the reference plane $E_R$ after the positioning of the first beam 991 and then uninstalled again.

Figure 12:
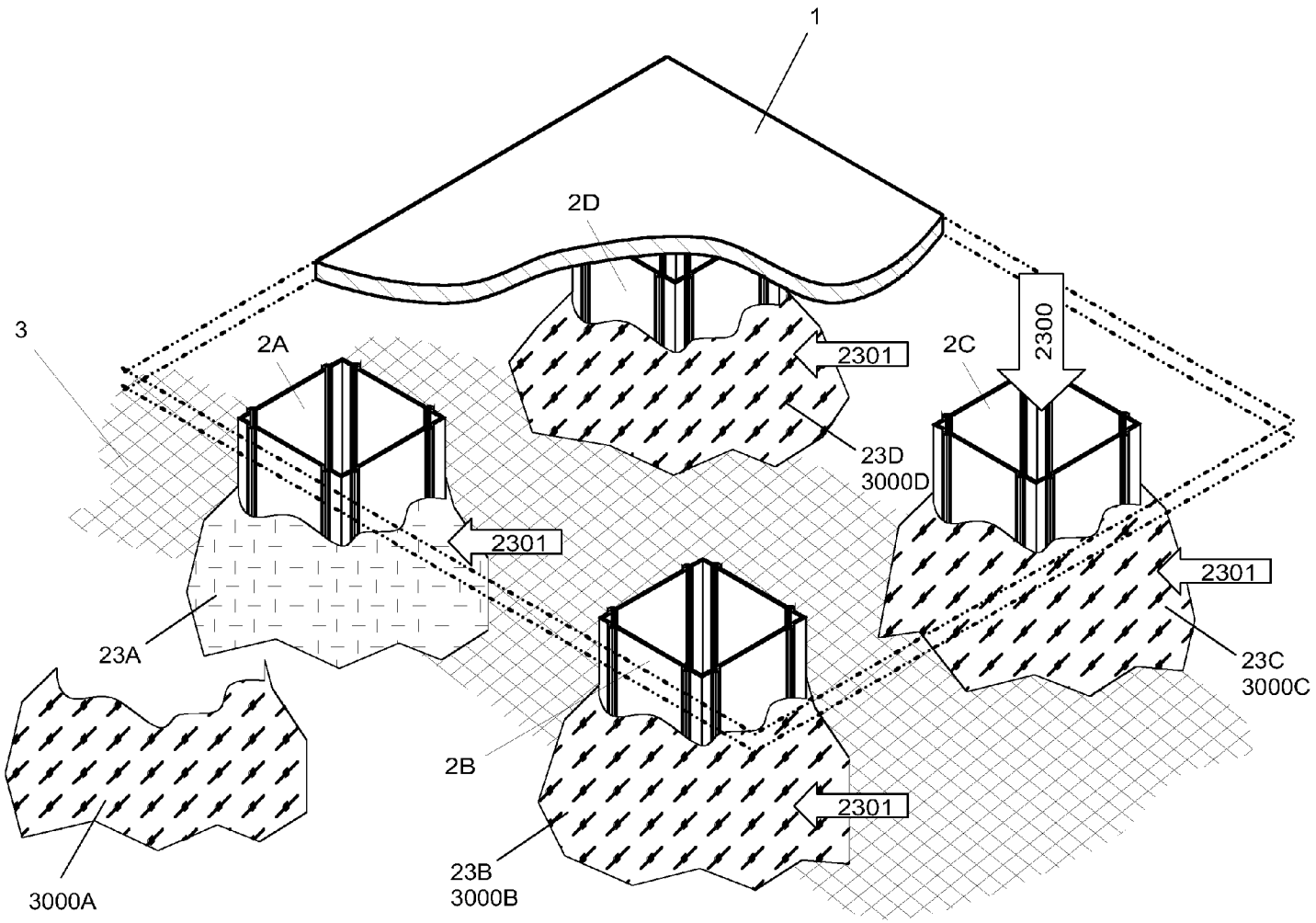
FIG. 12 shows four false-floor supports, which are preferably firmly connected to a floor panel and which comprise foot members that are connected to containers that are filled with pedestal material.

FIG. 12 shows four false-floor supports 2A, 2B, 2C and 2D that are preferably firmly connected with a floor panel 1 and that comprise containers 3000A, . . . 3000D at the foot members that are filled with pedestal material 2300. If the false-floor supports 2A, 2B, 2C and 2D have a tubular design then the pedestal material 2300 can be introduced through the false-floor supports 2A, 2B, 2C and 2D transferred into the containers 3000.

In this preferred embodiment of the invention, floor panels 1 are connected with false-floor supports 2A, 2B, 2C and 2D and can be positioned at a desired height, whereafter the pedestal material 2300 adapts to the bare floor 3 and is hardened. By positioning and aligning the floor panels 1 the pedestal material is pressed against the bare floor 3 and is laterally displaced as far as required. Thereby, the container 3000 can be removed or can remain. E.g., a container is provided, which consists of at least partially perforated material, e.g. a plastic foil, which allows air and/or water to pass. Symbolically it is shown that a material 2301 can be applied which allows acceleration of the curing process.

With this embodiment of the invention, floor panels 1 that are equipped with corresponding false-floor supports 2A, 2B, 2C and 2D and containers can quickly be positioned, aligned and therefore mounted in a short period of time. By the process of positioning the floor panels 1, the floor panels 1 can sequentially be coupled with one another, so that they lie precisely in a plane.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for the installation of a false floor above a bare floor with false-floor supports that are placed in a regular grid pattern on the bare floor, on which supports floor panels are arranged alongside one another in rows, comprising the steps of:

a. determining mounting positions for the false-floor supports and positioning the false-floor supports according to the mounting positions;

b. determining at least partially a mounting plane lying at a mounting height above the bare floor;

c. guiding the false-floor supports to be installed towards the mounting plane until a part thereof or a floor panel mounted on the false-floor supports is positioned at least approximately at the mounting height;

d. providing pedestals, the pedestals composed of a solidifying pedestal material binding to the bare floor and which project beyond the mounting plane, at the mounting positions before, during or after the positioning of the false-floor supports; and e. holding each of the false-floor supports in a respective one of the pedestals until the pedestal has solidified and, if not already present, mounting the floor panels on the false-floor supports.

2. The method according to claim 1 wherein the pedestal material is filled into structural members or containers that are provided for each of the false-floor supports:

wherein the structural members are positioned at the mounting positions and are filled with the pedestal material before the false-floor supports are positioned; or wherein the structural members are connected to the false-floor supports and are lowered together with the false-floor supports, whereafter the structural members are filled with the pedestal material which encloses foot members of the false-floor supports; or wherein the false-floor supports, which are provided each with a container are positioned so that the pedestal material provided in and released from the container can solidify on the bare floor and that the pedestals or the pedestal material is provided so that also the false-floor support positioned at a lowermost mounting position is supported on the bare floor by the related pedestals.

3. The method according to claim 2 wherein the mounting positions are determined sequentially or in groups and the pedestals are positioned sequentially or in groups and the false-floor supports, which consist of one or more parts, are inserted sequentially or in groups into the pedestals.

4. The method according to claim 1 wherein the mounting positions are determined sequentially or in groups and the pedestals are positioned sequentially or in groups and the false-floor supports, which consist of one or more parts, are inserted sequentially or in groups into the pedestals.

5. The method according to claim 1 wherein the pedestal material used for creating the pedestals is one of a concrete mix, a concrete for floors, a cement mix and a plaster, which pedestal material is composed and applied to solidify in a timespan in which the false-floor supports are mounted.

6. The method according to claim 1 wherein at least a part of a reference grid that lies in a horizontal reference plane is determined so that the mounting plane is at least partially defined at the mounting height in a distance in parallel to the reference plane.

7. The method according to claim 1 including providing an installation device with a holding device to form a device grid with at least two or more device positions, wherein the device grid corresponds to a mounting grid and is arranged within a device plane, and wherein the false-floor supports, alone or together with structural members, are mounted at the device positions, and wherein the device plane of the holding device is aligned in parallel or congruent to the reference plane and then is driven along a distance in parallel towards the mounting plane, which is defined so that lower ends of the false-floor supports reach the mounting plane after the distance has been traversed; or wherein the device plane of the holding device is aligned in parallel or congruent to the reference plane and then is driven along a distance in parallel towards the mounting plane until one or more sensors signal that a mounting and reference plane has been reached, which is selected in so that the lower ends of the false-floor supports have reached the mounting plane when the sensors are activated.

8. The method according to claim 7 wherein the holding device is supported and is vertically displaced by two or more lifting devices.

9. The method according to claim 8, wherein the installation device comprises a measuring device that delivers correction signals for inclinations of the device plane relative to the mounting plane to a control unit that corrects the inclination by controlling the at least one lifting device, or that each of the lifting devices is controlled depending on the signals provided by a related sensor.

10. The method according to claim 9 wherein after the movement of the false-floor supports into the mounting positions the holding device is fixed by auxiliary supports and the lifting devices or drive devices provided in the lifting devices are removed.

11. The method according to claim 8 wherein after the movement of the false-floor supports into the mounting positions the holding device is fixed by auxiliary supports and the lifting devices or drive devices provided in the lifting devices are removed.

12. An installation device for the execution of the method according to claim 1 including a holding device which consists of one or more parts, and which comprises a unidimensional or two-dimensional device grid arranged in a device plane comprising two or more device positions provided with coupling devices for releasably holding the false-floor supports, and which is connected to manually or automatically operable lifting devices with which the holding device is displaced vertical to the device plane.

13. The installation device according to claim 12 wherein each of the lifting devices comprises a drive device.

14. The installation device according to claim 12 including a control unit connected to sensors for driving the lifting devices for leveling and/or aligning the holding device in a reference plane and for driving the holding device in parallel to the reference plane.

15. A false floor installed according to the method of claim 1 above the bare floor with the false-floor supports that are placed in a regular grid pattern on the bare floor and on which the floor panels are arranged alongside one another in rows, wherein pedestals are positioned on the bare floor into which the false-floor supports are inserted with lower ends at least approximately at the mounting height of the mounting plane that is aligned in parallel to the installed floor panels.

16. The false floor according to claim 15 wherein a plurality of the false-floor supports are connected with a single floor panel and which are provided with solidified pedestal material at a foot member that is adapted to the bare floor and that is enclosed in a container or has been released from a container.

17. The false floor according to claim 16 wherein the pedestals are made from one of concrete, concrete for floors, cement or plaster, and are held in a structural element.

18. The false floor according to claim 15 wherein the pedestals are made from one of concrete, concrete for floors, cement or plaster, and are held in a structural element.

* * * * *